US005217111A

United States Patent [19]

Castonguay et al.

[11] Patent Number: 5,217,111

[45] Date of Patent: Jun. 8, 1993

[54] SCREW RETAINER FOR A MOLDED CASE CIRCUIT BREAKER MOVABLE CONTACT ARM ARRANGEMENT

[75] Inventors: Roger N. Castonguay, Terryville; David Arnold, Chester, both of Conn.

[73] Assignee: General Electric Company, New York, N.Y.

[21] Appl. No.: 883,634

[22] Filed: May 15, 1992

[51] Int. Cl.[5] ..... H01H 9/00

[52] U.S. Cl. ..... 200/401

[58] Field of Search ..... 200/401, 294

[56] References Cited

U.S. PATENT DOCUMENTS 3,134,051 5/1964 Lyon ..... 200/294 X 4,650,272 3/1987 Doughty et al. .

4,931,603 6/1990 Castonguay et al. ..... 200/144

*Primary Examiner*—Renee S. Luebke

*Attorney, Agent, or Firm*—Richard A. Menelly

[57] ABSTRACT

A screw retainer is fabricated from a thin sheet of spring steel and is comprised of three sections: a screw support section, a leg support section and a leg section. The screw support section contains a through-hole for receiving a support screw. The leg support section is bounded by the screw-support section and the leg section. The leg section is angulated with respect to the leg support section and has a degree of spring action that allows it to be compressed so as to allow it and the leg support section to be inserted between the respective lower portions of integrally-formed upstanding support arms of a support base. Once the screw retainer is completely inserted between the respective lower portions of the integrally-formed upstanding support arms, the leg section springs back to its normal position thereby preventing the screw retainer from becoming dislodged from its position.

1 Claim, 3 Drawing Sheets

SCREW RETAINER FOR A MOLDED CASE CIRCUIT BREAKER MOVABLE CONTACT ARM ARRANGEMENT

BACKGROUND OF THE INVENTION

The screw retainer of the present invention is used in conjunction with a molded case circuit breaker movable contact arm arrangement that is described in commonly assigned U.S. Pat. No. 4,931,603, issued Jun. 5, 1990, entitled "Molded Case Circuit Breaker Movable Contact Arm Arrangement". The Patent describes a molded case circuit breaker movable contact arm that is positioned within the circuit breaker case by means of a support base that includes integrally-formed upstanding support arms. The movable contact arm is mechanically and electrically connected between the upstanding support arms. The movable contact arm utilizes a shaped antiturn screw retainer which includes an integrally-formed H-shaped top part with a pair of oppositely depending legs. The screw retainer is formed from a spring metal with legs cantilevered toward each other and having radial-shaped ends. The screw retainer has a through-hole formed in the H-shaped top part to receive and retain a support screw. The support base is formed to provide an offset end having a through-hole, that accepts the support screw that is utilized to fasten the support base to a circuit breaker load strap.

During the manufacture of molded case circuit breaker components utilizing the screw retainer described within aforementioned U.S. Pat. No. 4,931,603 via robotic or automated systems, the screw retainer may become dislodged. This is typically the result of the motion of robotic arms utilized to engage the movable contact arm arrangement. Attaching a replacement screw retainer onto the movable contact arm arrangement once the movable contact arm arrangement is inserted into the molded case is difficult to accomplish.

Typically, the movable contact arm arrangement must be manually extracted in order to insert the replacement screw retainer. This is a time consuming process that degrades the efficiency of a robotic or automated manufacturing system.

In commonly assigned U.S. Pat. No. 4,650,272, issued Mar. 17, 1987, entitled "Circuit Breaker Line Terminal Screw Retainer", to Doughty, et al., there is described a composite line terminal strap that is used with a molded case circuit breaker to support a circuit breaker stationary contact and to retain a circuit breaker line terminal screw. The circuit breaker stationary contact is welded to the line strap within the circuit breaker at a first end and the line terminal screw is attached to an opposite end of the line strap by a through-hole in a spring-steel retainer which extends partially within the circuit breaker. The line terminal screw is tightly held within the through-hole of the retainer at the first end and the retainer itself is trapped between the bottom of the circuit breaker case and the line strap at the opposite end of the line strap.

One purpose of the present invention is to provide a screw retainer that is positioned on the support base, of the contact arm arrangement described in U.S. Pat. No. 4,931,603, in such a manner that it cannot become dislodged during the manufacturing process of a molded case circuit breaker.

It is another object of the invention to provide a screw retainer of very simple construction.

Other objects and advantages of the invention will appear from reading the following description of the invention, with reference to the accompanying drawings.

SUMMARY OF THE INVENTION

The screw retainer of the present invention is an improvement upon the screw retainer described in commonly assigned U.S. Pat. No. 4,931,603 issued Jun. 5, 1990, entitled "Molded Case Circuit Breaker Movable Contact Arm Arrangement" to Castonguay et al. which is directed to a movable contact arm arrangement for use in a molded case circuit breaker. The movable contact arm arrangement is positioned within the circuit breaker case by means of a support base that includes integrally-formed upstanding support arms.

The metal retainer plate or screw retainer of the present invention is fabricated from a thin sheet of spring steel and is comprised of three sections: a screw support section, a leg support section and a leg section. The screw support section contains a through-hole for receiving a support screw. The leg support section is bounded by the screw-support section and the leg section. The leg section is angulated with respect to the leg support section and has a degree of spring action that allows it to be compressed so as to allow it and the leg support section to be inserted between the respective lower portions of the integrally-formed upstanding support arms of the support base as described in the aforementioned U.S. Pat. No. 4,931,603. Once the screw retainer is completely inserted between the respective lower portions of the integrally-formed upstanding support arms, the leg section springs back to its normal position thereby preventing the screw retainer from becoming dislodged from its position.

DESCRIPTION OF THE PREFERRED EMBODIMENT

A brief description of the screw retainer of the prior art is presented in order to aid in the understanding of the screw retainer of the present invention and its utilization with other circuit breaker components.

Figure 1A:
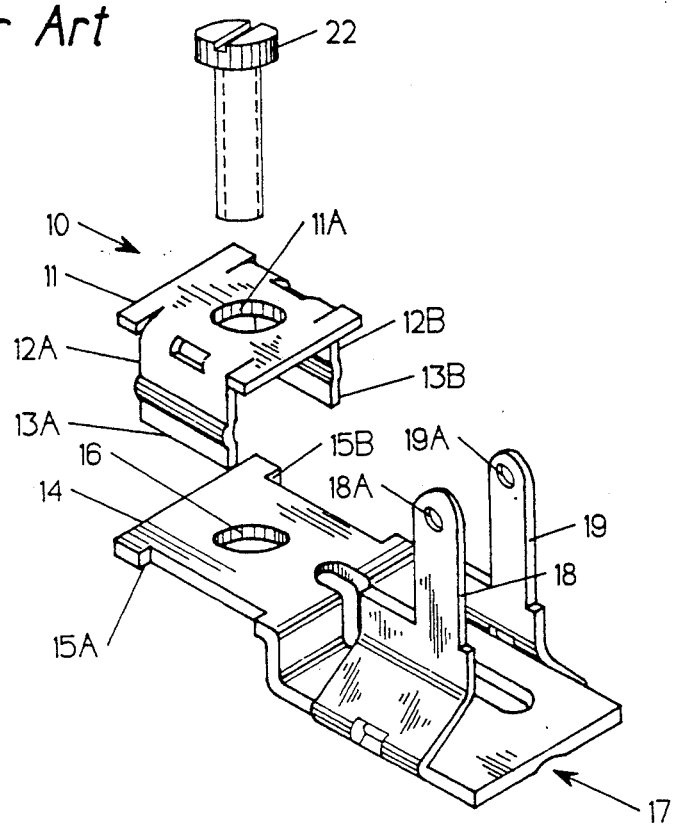
FIG.1A Prior Art
FIG. 1A is a top perspective view, in isometric projection, of a screw retainer according to the prior art and a support base to which the screw retainer is mounted.
Figure 1B:
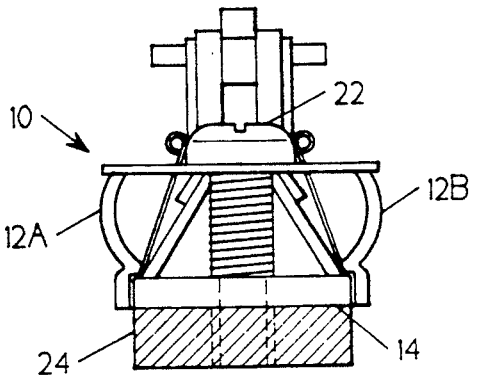
FIG. 1B Prior Art
FIGS. 1B and 1C are end views of the support base and screw retainer shown in FIG. 1A.
Figure 1C:
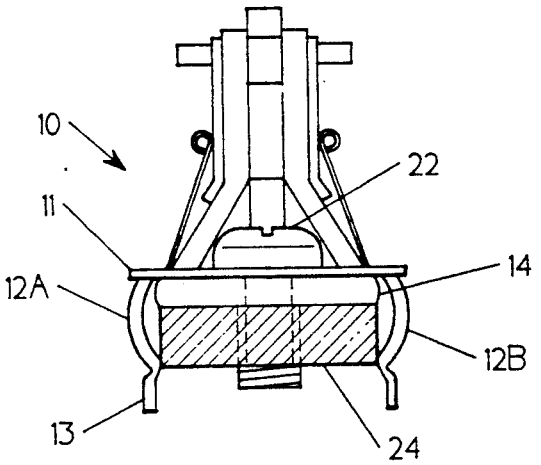
FIG. 1C Prior Art

Screw retainer 10 of the prior art, shown in FIG. 1A, is utilized with a movable contact arm arrangement as described in the aforementioned U.S. Pat. No. 4,931,603. Screw retainer 10 includes an integrally-formed H-shaped top part 11 with a pair of oppositely depending legs 12A, 12B. Screw retainer 10 is formed from a spring metal with legs 12A, 12B cantilevered toward each other and having radial-shaped ends 13A, 13B. Screw retainer 10 has a through-hole 11A formed in the H-shaped top part 11 to receive and retain a support screw 22. Screw retainer 10 is assembled on support base 17 which includes a pair of integrally-formed upstanding support arms 18, 19. Through-holes 18A, 19A, formed within upstanding support arms 18, 19, receive a pivot pin (not shown) that supports the movable contact arm (not shown). Support base 17 is formed to provide offset end 14 having through-hole 16, which accepts support screw 22 that is utilized to fasten support base 17 to circuit breaker load strap 24 (see FIGS. 1B and 1C). A pair of slots 15A, 15B, formed out-board on offset end 14, receive screw retainer legs 12A, 12B when screw retainer 10 and support screw 22 are positioned on support base 17. Support screw 22 is captured within H-shaped top part 11 of screw retainer 10. When screw retainer 10 is first assembled on offset end 14 of support base 17, radial-shaped ends 13A, 13B of legs 12A, 12B engage the sides of offset end 14 which positions support screw 22 over load strap 24. As illustrated in FIGS. 1B and 1C, when support screw 22 is attached to load strap 24, screw retainer 10 is forced downwards such that legs 12A, 12B straddle both offset end 14 and load strap 24.

Figure 2A:
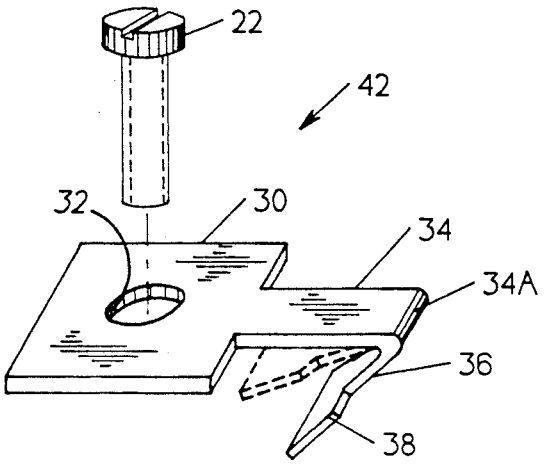
FIG. 2A is a top perspective view, in isometric projection, of the screw retainer of the present invention.
Figure 2B:
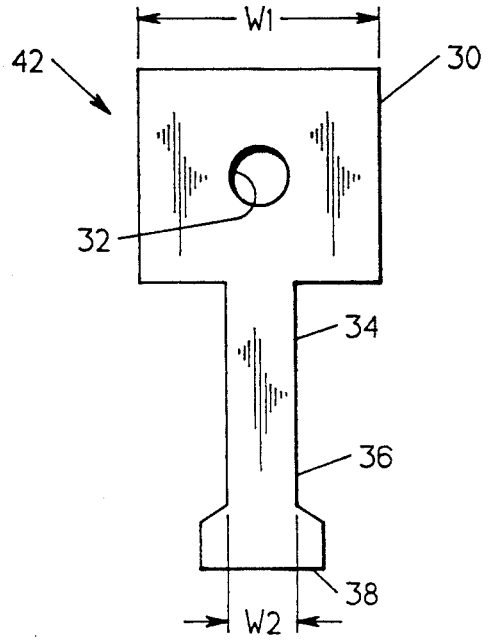
FIG. 2B is a top plan view of the screw retainer of the present invention prior to being formed in accordance with the configuration shown in FIG. 2A.
Figure 2C:
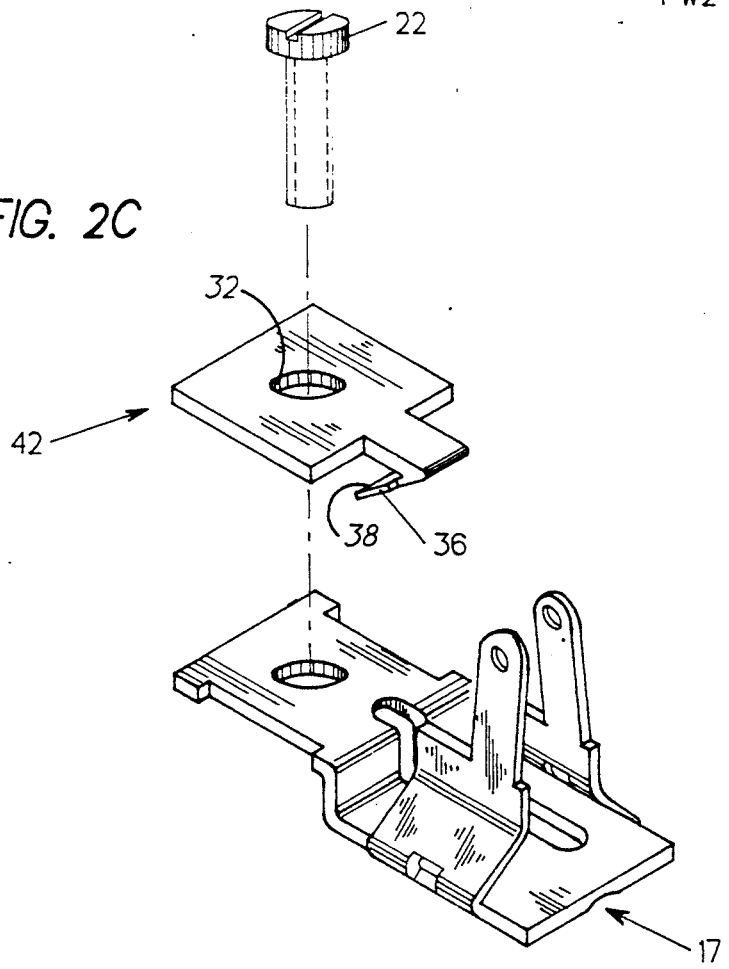
FIG. 2C is a top perspective view, in isometric projection, of the screw retainer of the present invention and the support base to which the screw retainer is mounted.

Screw retainer 42 of the present invention, as shown in FIGS. 2A–2C, is fabricated from a thin sheet of spring steel and is comprised of three sections: screw support section 30, leg support section 34 and leg section 36. As best shown in FIG. 2B, screw support section 30 has a width W1 and contains through-hole 32 for receiving support screw 22. Leg support section 34 is bounded by screw support section 30 and leg section 36. Leg section 36 is bounded by leg support section 34 and flanged end 38. Leg support section 34 and leg section 36 both have a width W2 that is substantially less than width W1. As shown in FIG. 2A, leg section 36 is angulated with respect to leg support section 34 and has a degree of spring action that allows it to be compressed about a fold 34A to the position designated by the dashed lines. The positional relationship of the screw 22 and screw retainer 42 prior to positioning on the support base 17 is depicted in FIG. 2C.

Figure 3A:
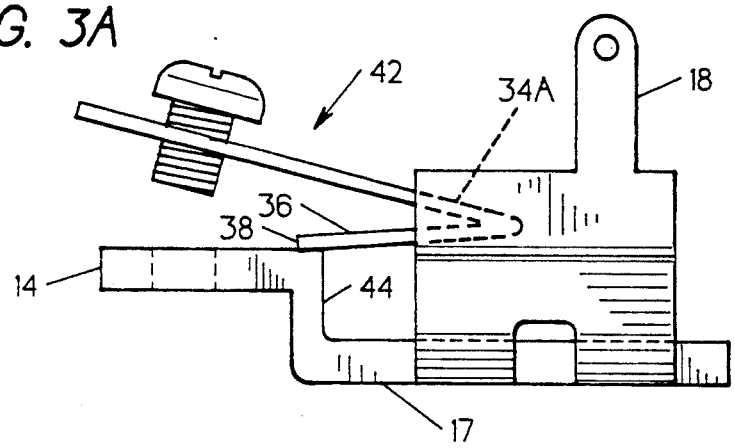
FIG. 3A is a side view of the screw retainer of the present invention with its leg section compressed so as to allow insertion between respective lower portions of the upstanding support arms of the support base.

FIG. 3A depicts a transitional position of screw retainer 42 wherein leg section 36 is compressed to a first position prior to insertion within the stepped-part 44 of the copper metal conductor plate or support base 17 formed between the offset end 14 and the support arms, one of which is depicted at 18. The space W3 between support arms 18, 19 (FIG. 3C) cannot accommodate screw support section 30 since the width W1 (FIG. 2B) of screw support section 30 is substantially larger than the width W2 of leg support section 34 and leg section 36.

Figure 3B:
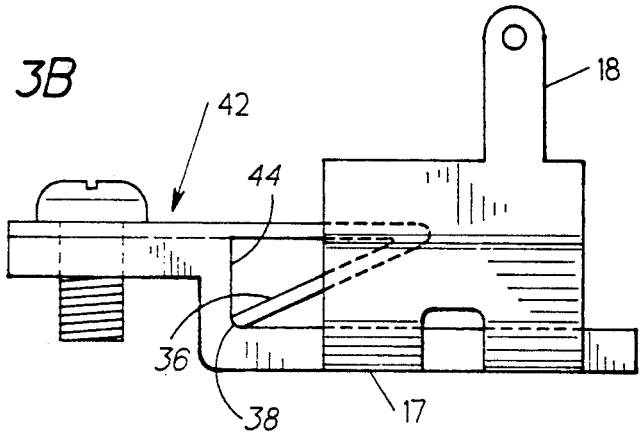
FIG. 3B is a side view of the screw retainer of the present invention positioned between the respective lower portions of the upstanding support arms of the support base.

FIG. 3B depicts screw retainer 42 completely inserted and positioned between the lower portions of the upstanding support arms. Once screw retainer 42 is completely inserted between the lower portions, the leg section 36 expands back to its normal position, designated in solid lines in FIG. 2A. As better shown in FIG. 3B, the end 38 of the leg section 36 physically contacts the stepped-part 44 of the support base 17 thus preventing screw retainer 42 from becoming dislodged. End 38 is flanged so as to increase the area of physical contact between the stepped-part 44 and the leg section 36.

Figure 3D:
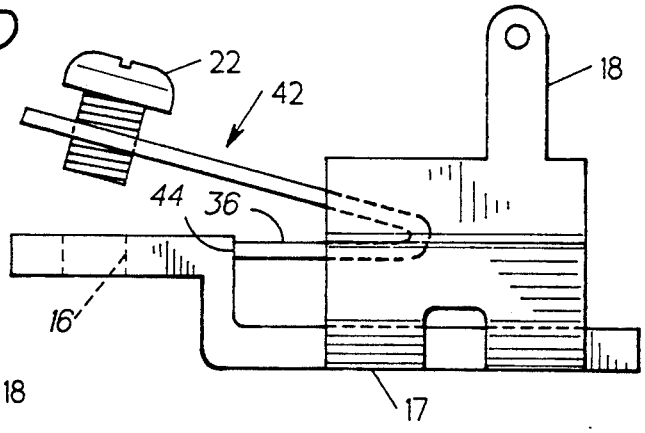
FIG. 3D is a side view of the screw retainer of the present invention positioned between the respective lower portions of the upstanding support arms of the support base.
Figure 3C:
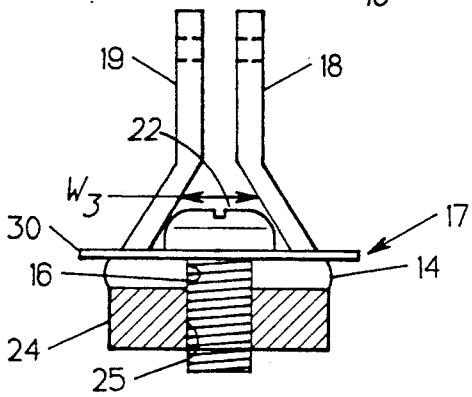
FIG. 3C is an end view of the support base and screw retainer of FIG. 3B wherein the support base is attached to a circuit breaker load strap via a support screw retained by the screw retainer.

As shown in FIGS. 3C, 3D, screw support section 30 positions support screw 22 over through-hole 16 in offset end 14 of the screw retainer 42. Although screw retainer 42 is attached to the support base 17, the screw support section 30 is capable of moving in a manner sufficient to allow the support screw 22 to be aligned with the screw inlet 25 on the circuit breaker load strap 24 after the offset end 14 has been made flush with load strap 24. Thus, the possibility of damaging the threads of support screw 22 or of the screw-inlet 25 due to misalignment is reduced. When support screw 22 is attached to circuit breaker load strap 24, screw support section 30 becomes flush with the top surface of offset end 14.

Since screw retainer 42 is securely positioned on the support base 17 and securely retains support screw 22, valuable manufacturing time is saved because the screw and screw retainer cannot become dislodged due to the motion of robotic arms that are utilized in a robotic or automated manufacturing process. The screw retainer is fully retained on the support base 17 even when the screw 22 is unthreaded from the through-hole 16 by interaction between the end 38 of the leg section 36 with the stepped-part 44 as best seen in FIG. 3D.

While a preferred embodiment of the invention has been disclosed in detail, it should be understood by those skilled in the art that various modifications may be made to the illustrated embodiment without departing from the scope of the invention. The invention is thus not to be construed to be limited only to the disclosed embodiment, but it is instead intended to be limited only as defined by the appended claims.

Having thus described our invention, what we claim as new and desire to secure by Letters Patent is:

1. A line terminal strap for a molded case circuit breaker comprising:

a metal conductor plate having means at a first end for attaching a movable contact carrier and means at a second end for receiving a load terminal screw for attaching said conductor plate to a load strap, said conductor plate further including a stepped part intermediate first and second ends;

an angled metal retainer plate having a top end and a bottom end superimposed on said conductor plate, said retainer plate having means at said top end for fixedly engaging said load terminal screw when inserted through said conductor plate receiving means; and said bottom end of said retainer plate being adapted for retention against said stepped part when said retainer plate is superimposed on said conductor plate, said retainer plate defining a fold intermediate said top and bottom ends, said fold interfering with a bottom part of said contact carrier attaching means to thereby force said retainer plate bottom end against said stepped part.

* * * * *